US007796932B2

(12) United States Patent
Geyling et al.

(10) Patent No.: US 7,796,932 B2
(45) Date of Patent: Sep. 14, 2010

(54) FUSER ASSEMBLY INCLUDING A NIP RELEASE MECHANISM

(75) Inventors: Alexander J Geyling, Lexington, KY (US); Michael David Maul, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 774 days.

(21) Appl. No.: 11/668,635

(22) Filed: Jan. 30, 2007

(65) Prior Publication Data

US 2008/0181686 A1 Jul. 31, 2008

(51) Int. Cl.
*G03G 15/20* (2006.01)

(52) U.S. Cl. ..... 399/329; 399/328

(58) Field of Classification Search ..... 399/122, 399/328–331, 338–339, 320, 321
See application file for complete search history.

(56) References Cited

U.S. PATENT DOCUMENTS 5,210,579 A * 5/1993 Setoriyama et al. ..... 399/338
6,253,046 B1 * 6/2001 Horrall et al. ..... 399/124
2005/0063743 A1 * 3/2005 Cho et al. ..... 399/328
2006/0096084 A1 5/2006 Hamilton et al.

OTHER PUBLICATIONS

Embry et al. entitled Retraction, Mechanism for a Toner, U.S. Appl. No. 11/669,206, filed Jan. 31, 2007, Image Transfer Apparatus.

* cited by examiner

*Primary Examiner*—David M Gray
*Assistant Examiner*—Billy J Lactaoen

(57) ABSTRACT

A fuser assembly is provided comprising first and second fuser structures, drive apparatus and nip engagement and release apparatus. The first fuser structure comprises a heated rotatable member and first structure for supporting the heated rotatable member. The second fuser structure comprises a rotatable backup member positioned adjacent the heated rotatable member and second structure for supporting the backup member. The rotatable backup member is adapted to define a nip with the heated member. The drive apparatus is associated with one of the heated rotatable member and the backup member for effecting rotation of the one member in a selected first direction or a second direction. The nip engagement and release apparatus comprises nip-loading structure adapted to apply a sufficient force to one of the first and second support structures to achieve a desired nip load in response to the one member rotating in the first direction and decreasing the force to the one support structure to decrease the load at the nip in response to the one member rotating in the second direction. The nip engagement and release apparatus applies and decreases the force without the use of a sensor feedback loop.

18 Claims, 10 Drawing Sheets

FUSER ASSEMBLY INCLUDING A NIP RELEASE MECHANISM

This application is related to U.S. patent application Ser. No. 11/669,206, entitled "RETRACTION MECHANISM FOR A TONER IMAGE TRANSFER APPARATUS," which is filed concurrently herewith and hereby incorporated by reference herein.

FIELD OF THE INVENTION

The present invention relates to a fuser assembly including a nip release mechanism, wherein the nip release mechanism functions without a sensor feedback loop.

BACKGROUND OF THE INVENTION

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser assembly. A fuser assembly may include a heated roll and a backup roll forming a fuser nip through which the media passes. A fuser assembly may also include a fuser belt and an opposing backup member, such as a backup roll.

Traditionally, the fuser rolls and belts comprise an outer compliant layer. These compliant layers can be deformed permanently, i.e., compression set, if left inactive and under pressure for prolonged periods of time. The deformation can lead to print defects.

U.S. Pat. No. 6,253,046 discloses a fuser assembly comprising hot and backup rolls. A fuser roll nip release mechanism is provided for relieving a pressure between the rolls during non-use of the fuser assembly. A feedback system comprising one or more sensors in combination with a controller is used to control the position of the nip release mechanism and, hence, the hot and backup rolls.

It would be desirable to have a nip release mechanism not requiring a sensor feedback system so as to reduce the cost of the mechanism.

SUMMARY OF THE INVENTION

In accordance with a first aspect of the present invention, a fuser assembly is provided comprising first and second fuser structures, drive apparatus, and nip engagement and release apparatus. The first fuser structure comprises a heated rotatable member and first support structure for supporting the heated rotatable member. The second fuser structure comprises a rotatable backup member positioned adjacent the heated rotatable member and second support structure for supporting the backup member. The rotatable backup member is adapted to define a nip with the heated member. The drive apparatus is associated with one of the heated rotatable member and the backup member for effecting rotation of the one member in a selected first direction or a second direction. The nip engagement and release apparatus comprises nip-loading structure adapted to apply a sufficient force to one of the first and second support structures to achieve a desired nip load in response to the one member rotating in the first direction and is further adapted to decrease the force to the one support structure to decrease the load at the nip in response to the one member rotating in the second direction. The nip engagement and release apparatus applies and decreases the force without the use of a sensor feedback loop.

The first fuser structure may further comprise a heater element. The first support structure may comprise a bracket supporting the heater element and first and second endcaps for supporting the bracket. The heated rotatable member may comprise an endless belt. The belt may be positioned about and supported by the heater element and the bracket.

The backup member may comprise a backup roll. The second support structure may comprise a pair of bearings mounted within a frame for supporting the backup roll.

The drive apparatus may comprise a motor and a gear train. The gear train may include a gear coupled to the backup roll.

The nip engagement and release apparatus may further comprise at least one spring, a swing arm assembly and a cam assembly. At least one spring may engage the nip-loading structure. The swing arm assembly is adapted to pivot to a first position in response to the one member rotating in the first direction and to a second position in response to the one member rotating in the second direction. The cam assembly includes at least one cam element for positioning the nip-loading structure to apply the sufficient force to the one support structure in response to the one member rotating in the first direction and for positioning the nip-loading structure to decrease the force applied to the one support structure in response to the one member rotating in the second direction.

The swing arm assembly may comprise first and second spaced-apart mounting plates, first, second and third gears and a drag generating member. The first and second plates are coupled to one another. The first gear is mounted between the first and second mounting plates and is adapted to engage with a gear forming part of the drive apparatus. The swing arm assembly pivots about an axis of the first gear. The drag generating member is provided between the first plate and the first gear. The drag generating member transfers a force via friction from the first gear to the first mounting plate in response to rotation of the first gear. The force may cause the first and second plates to pivot in response to movement of the first gear. The second and third gears are mounted between the mounting plates and in engagement with the first gear for rotation with the first gear.

The cam assembly may comprise a sector gear, a cam shaft, and a first cam element. The sector gear may comprise a first segment including teeth and a second segment devoid of teeth. The cam shaft may be coupled to the sector gear for rotation with the sector gear. The first cam element may be coupled to the cam shaft for rotation with the cam shaft. The second gear causes the sector gear to rotate to effect movement of the cam shaft to cause the first cam element to position the nip-loading structure to apply the sufficient force to the one support structure and the third gear causes the sector gear to rotate to cause the first cam element to position the nip-loading structure to decrease the force applied to the one support structure.

The cam assembly may further comprise a second cam element.

The nip-loading structure may comprise first and second levers. The first lever may be pivotably coupled at a first end to a frame and comprise an intermediate portion for engaging the one support structure and a second end for engaging the first cam element. The second lever may be pivotably coupled at a first end to the frame and comprise an intermediate portion for engaging the one support structure and second end for engaging the second cam element.

At least one spring of the nip engagement and release apparatus may comprise first and second springs. The first spring may extend between the frame and the first lever and the second spring may extend between the frame and the second lever.

The drag generating member comprises a spring or other element causing interference between the first plate and the first gear.

In accordance with a second aspect of the present invention, a pressure application assembly is provided comprising first and second structures, a drive apparatus and nip engagement and release apparatus. The first structure comprises a first rotatable member and first support structure for supporting the first rotatable member. The second structure comprising a second rotatable member positioned adjacent the first rotatable member and second support structure for supporting the second member. The second member is adapted to define a nip with the first member. The drive apparatus is associated with one of the first rotatable member and the second rotatable member for effecting rotation of the one member in a selected first direction or a second direction. The nip engagement and release apparatus comprises nip-loading structure adapted to apply a sufficient force to one of the first and second support structures to achieve a desired nip load in response to the one member rotating in the first direction and decreasing the force to the one support structure to decrease the load at the nip in response to the one member rotating in the second direction. The nip engagement and release apparatus applies and decreases the force without the use of a sensor feedback loop.

DETAILED DESCRIPTION OF THE INVENTION

In the following detailed description of the preferred embodiment, reference is made to the accompanying drawings that form a part herein, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
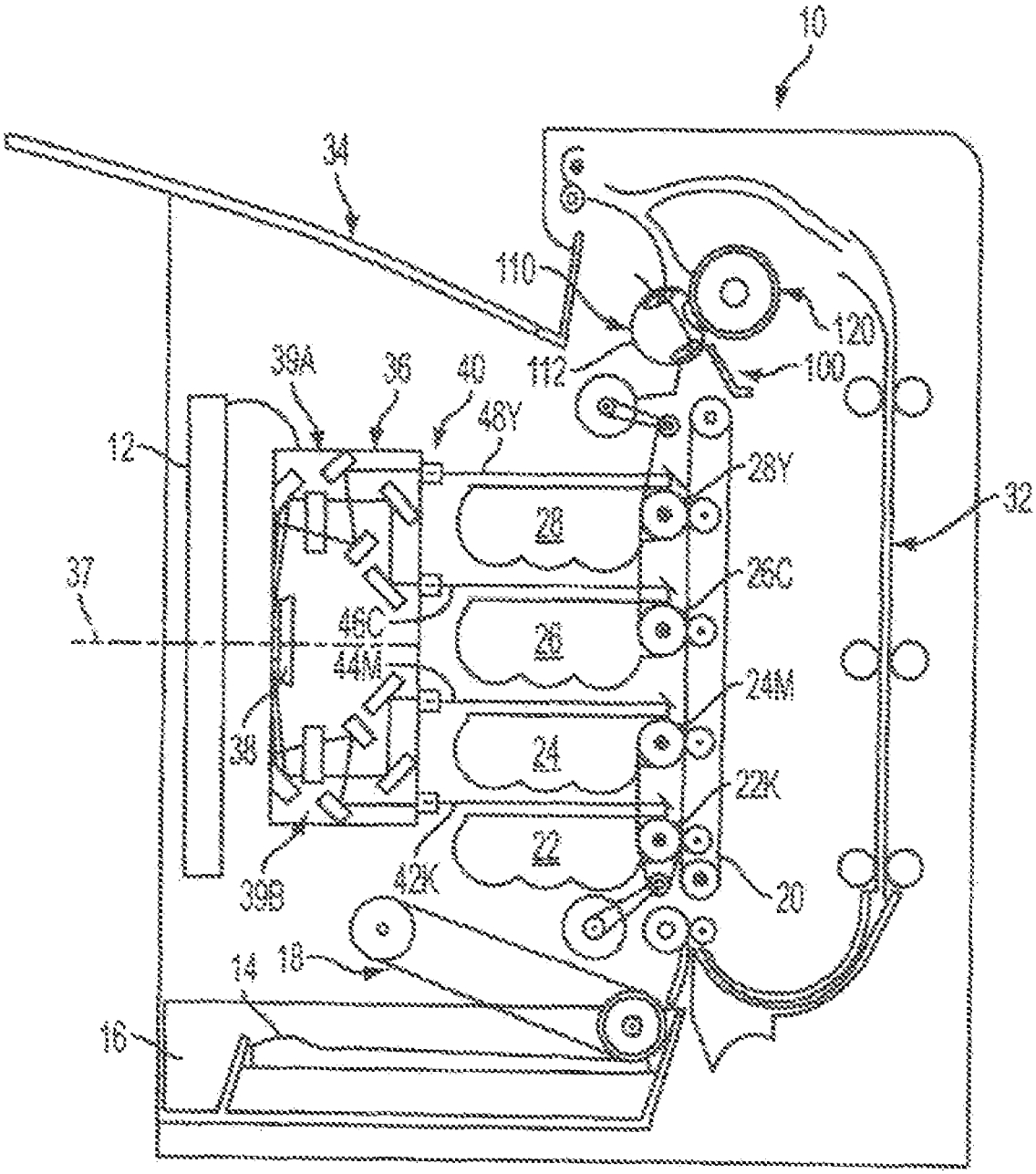
FIG. 1 is a schematic view of a printer including a fuser assembly constructed in accordance with the present invention.

FIG. 1 depicts a representative electrophotographic image forming apparatus, such as a color laser printer, which is indicated generally by the numeral 10. An image to be printed may be electronically transmitted to a print engine controller or processor 12 by an external device (not shown) or may comprise an image stored in a memory of the processor 12. The processor 12 includes system memory, one or more processors, and other logic necessary to control the functions of electrophotographic imaging.

In performing a printing operation, the processor 12 initiates an imaging operation where a top substrate 14 of a stack of media is picked up from a media tray 16 by a pick mechanism 18 and is delivered to a media transport belt 20. The media transport belt 20 carries the substrate 14 past each of four image forming stations 22, 24, 26, 28, which apply toner to the substrate 14. The image forming station 22 includes a photoconductive drum 22K that delivers black toner to the substrate 14 in a pattern corresponding to a black image plane of the image being printed. The image forming station 24 includes a photoconductive drum 24M that delivers magenta toner to the substrate 14 in a pattern corresponding to the magenta image plane of the image being printed. The imaging forming station 26 includes a photoconductive drum 26C that delivers cyan toner to the substrate 14 in a pattern corresponding to the cyan image plane of the image being printed. The image forming station 28 includes a photoconductive drum 28Y that delivers yellow toner to the substrate 14 in a pattern corresponding to the yellow image plane of the image being printed. The processor 12 regulates the speed of the media transport belt 20, media pick timing and the timing of the image forming stations 22, 24, 26, 28 to effect proper registration and alignment of the different image planes to the substrate 14.

The media transport belt 20 then carries the substrate 14 with the unfused toner image superposed thereon to an image heating apparatus or fuser assembly 100, which applies heat and pressure to the substrate 14 so as to promote adhesion of the toner thereto. Upon existing the fuser assembly 100, the substrate 14 is either fed into a duplexing path 32 for performing a duplex printing operation on a second surface of the substrate 14, or the substrate 14 is conveyed from the apparatus 10 to an output tray 34.

To effect the imaging operation, the processor 12 manipulates and converts data defining each of the KMCY image planes into separate corresponding laser pulse video signals, and the video signals are then communicated to a printhead 36. The printhead 36 may include four laser light sources (not shown) and a single polygonal mirror 38 supported for rotation about a rotational axis 37, and post-scan optical systems 39A and 39B receiving the light beams emitted from the laser light sources. Each laser of the laser light sources emits a respective laser beam 42K, 44M, 46C, 48Y, each of which is reflected off the rotating polygonal mirror 38 and is directed towards a corresponding one of the photoconductive drums 22K, 24M, 26C and 28Y by select lenses and mirrors in the post-scan optical systems 39A, 39B.

Figure 2:
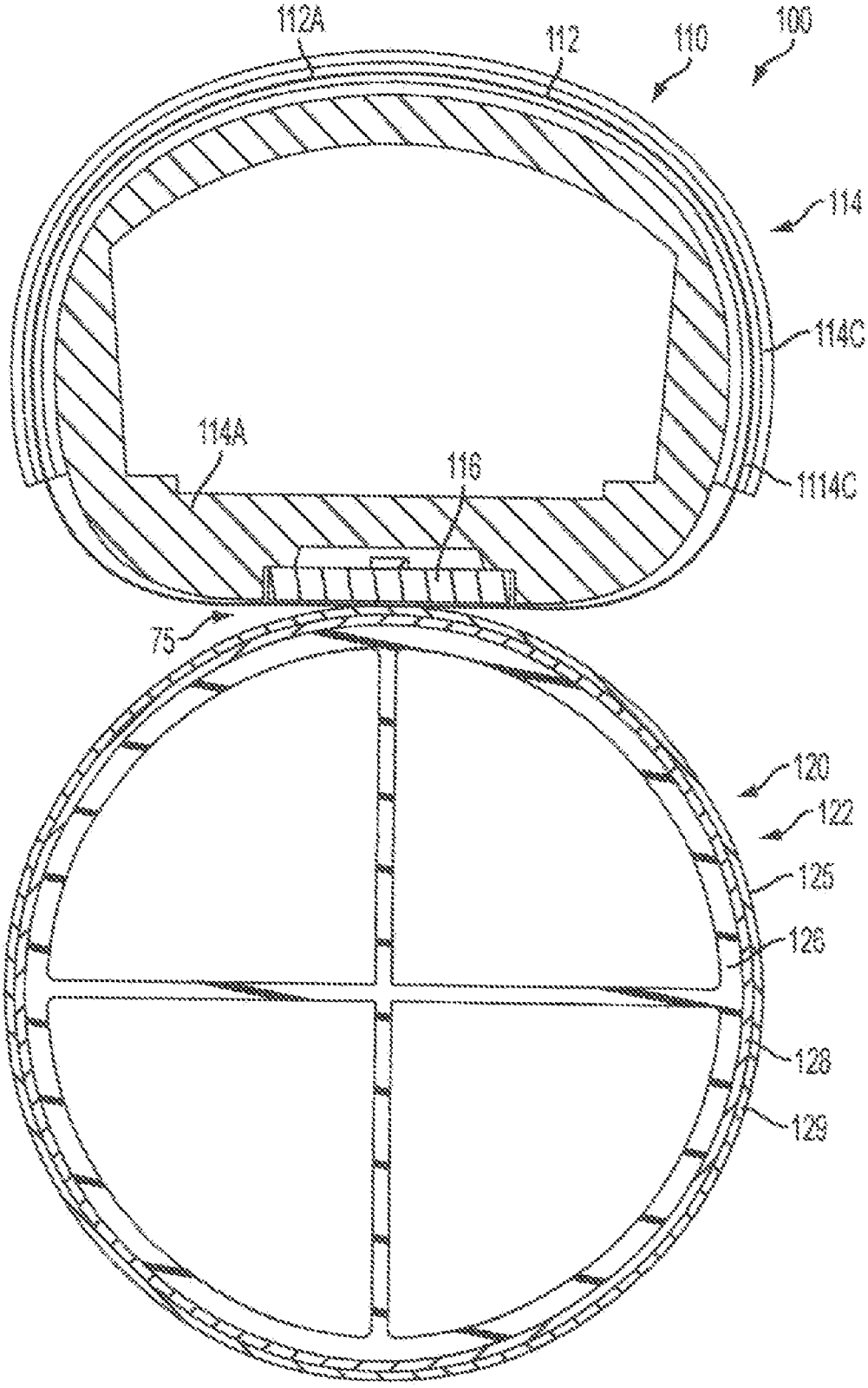
FIG. 2 is a cross sectional view of first and second fuser structures of the fuser assembly illustrated in FIG. 1.
Figure 3:
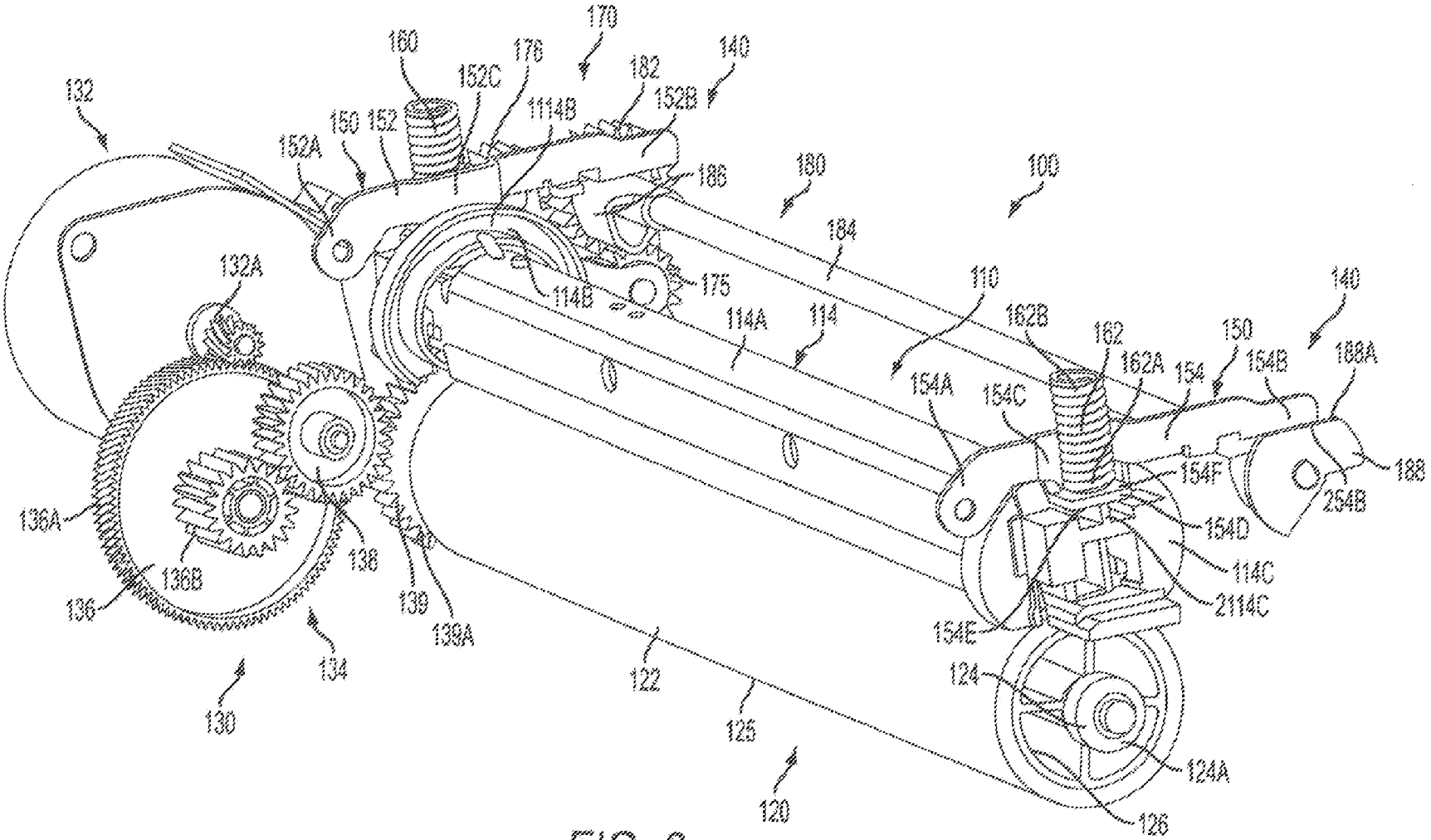
FIG. 3 is a perspective view of the fuser assembly illustrated in FIG. 1 without the main frame and showing a drive motor.

The fuser assembly 100 in the illustrated embodiment comprises first and second fuser structures 110 and 120, respectively, drive apparatus 130 and nip engagement and release apparatus 140, see FIG. 3. The first fuser structure 110 comprises a rotatable member 112, shown only in FIGS. 1 and 2, first support structure 114 for supporting the rotatable member 112, and a heater element 116 for heating the rotatable member 112, see also FIGS. 3 and 4. The first support structure 114 is coupled to a main frame 102 of the fuser assembly 100, see FIG. 5. The second fuser structure 120 comprises a rotatable backup member 122 positioned adjacent the heated rotatable member 112 and a second structure 125, see FIG. 3, for supporting the backup member 122. The rotatable backup member 122 defines a nip 75 with the heated rotatable member 112 for receiving a substrate 14 with a toner image thereon, see FIG. 2. The heated rotatable member 112 and the backup member 122 apply heat and pressure to the substrate 14 passing through the nip 75 to fuse the toner image to the substrate 14.

Figure 5:
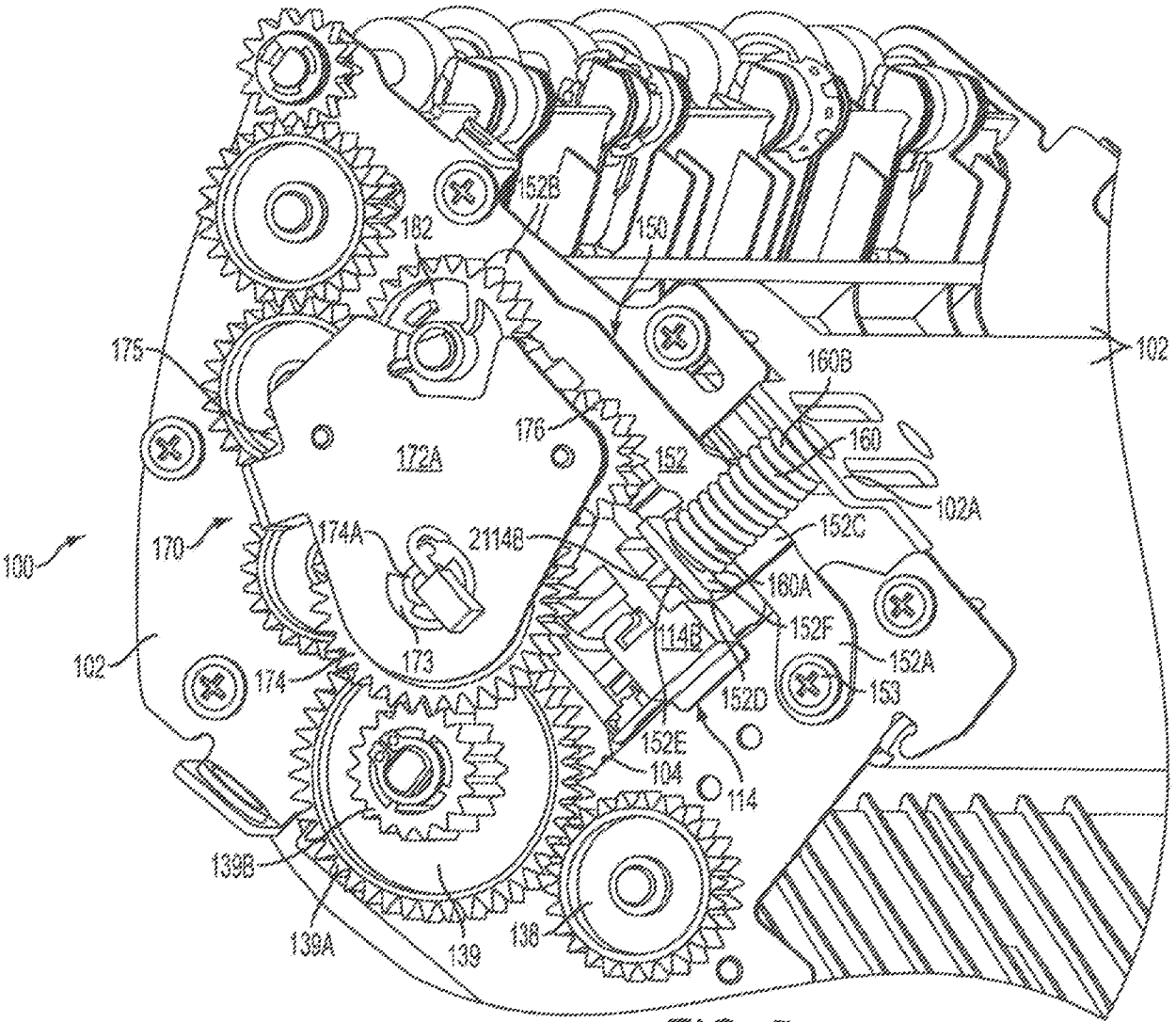
FIG. 5 is a perspective view of a portion of the fuser assembly illustrated in FIG. 1.

In the illustrated embodiment, the first support structure 114 comprises a bracket 114A supporting the heater element 116 and first and second endcaps 114B and 114C for supporting the bracket 114A. Each endcap 114B, 114C is received in a corresponding one of two slots 104, only one of which is shown in FIG. 5, in the main frame 102 of the fuser assembly 100. The endcaps 114B and 114C are capable of reciprocating movement within the slots 104.

The heated rotatable member 112 comprises an endless belt 112A, see FIG. 2. The belt 112A is positioned about the heater element 116 and the bracket 114A and ends of the belt 112A are received in recesses 1114B and 1114C formed in the first and second endcaps 114B and 114C, respectively, see FIGS. 2 and 3. The belt 112A may comprise a thin film, and preferably comprises a stainless steel tube covered with an elastomeric layer, such as a silicone rubber layer. The elastomeric layer is formed on the outer surface of the stainless steel tube so as to contact substrates 14 passing between the heater element 116 and the rotatable backup member 122.

In the illustrated embodiment, the rotatable backup member 122 comprises a backup roller 125 including an inner core 126, an inner polymeric layer 128 and an outer toner release layer or sleeve 129. The inner core 126 may be formed from a polymeric material, steel, aluminum or a like material. The inner polymeric layer 128 may be formed from a silicone foam or rubber material. The outer release layer 129 may comprise a sleeve formed from PFA (polyperfluoroalkoxytetrafluoroethylene) or other fluororesin material. The outer release layer 129 may also be formed via a latex and/or PFA spray coating.

The second structure 124 for supporting the backup member 122 comprises a pair of bearings 124A, only one of which is shown in FIG. 3. The bearings 124A are coupled to the main frame 102 of the fuser assembly 100.

In the illustrated embodiment, the drive apparatus 130 comprises a drive motor 132 including a pinion gear 132A and a speed reduction gear train 134. The gear train 134 comprises a first compound gear 136, shown only in FIG. 3, an intermediate gear 138 and a second compound gear 139, see also FIG. 4. A first portion 136A of the first compound gear 136 engages the pinion gear 132A while a second portion 136B of the first compound gear 136 engages the intermediate gear 138. The first portion 139A of the second compound gear 139 engages the intermediate gear 138 while the second portion 139B of the second compound gear 139 engages a first gear 174, to be described below. In the illustrated embodiment, the second compound gear 139 is fixedly coupled to the backup member 122 so as to rotate with the backup member 122. The drive motor 132 is controlled by the processor, which controls the rotational direction and speed of the motor 132.

In the illustrated embodiment, the nip engagement and release apparatus 140 comprises nip-loading structure 150, first and second springs 160 and 162, a swing arm assembly 170 and a cam assembly 180.

The nip-loading structure 150 comprises, in the illustrated embodiment, first and second levers 152 and 154, see FIGS. 3 and 5. The first lever 152 is pivotably coupled at a first end 152A to the main frame 102 via a pin 153. The first lever 152 further comprises a second end 152B and an L-shaped intermediate portion 152C including an extension 152D. A first side 152E of the first lever extension 152D engages an engagement member 2114B of the first endcap 114B. The second lever 154 is pivotably coupled at a first end 154A to the main frame 102 via a pin (not shown). The second lever 154 further comprises a second end 154B and an L-shaped intermediate portion 154C including an extension 154D, see FIG. 3. A first side 154E of the second lever extension 154D engages an engagement member 2114C of the second endcap 114C, see FIG. 3.

The first spring 160 comprises a compression spring having a first end 160A engaging a second side 152F of the first lever extension 152D and a second end 106B engaging a first extending portion 102A, shown only in FIG. 5, of the main frame 102. The second spring 162 comprises a compression spring having a first end 162A engaging a second side 154F of the second lever extension 154D and a second end 162B engaging a second extending portion (not shown) of the main frame 102.

Figure 4:
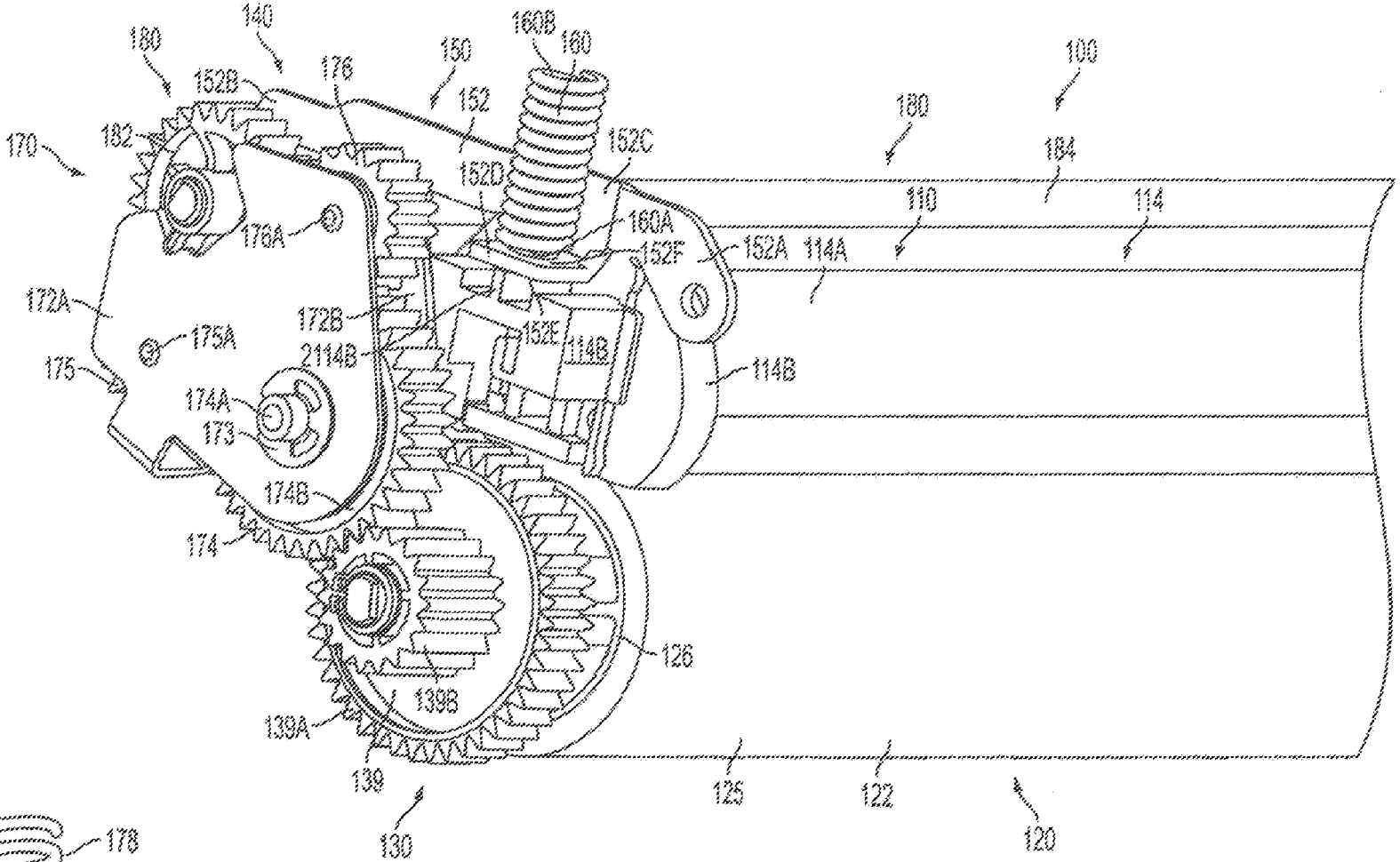
FIG. 4 is a perspective view of the swing arm assembly of the fuser assembly illustrated in FIG. 1.
Figure 4A:
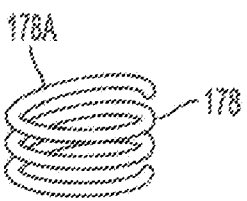
FIG. 4A is a side view of a drag generating member.

The swing arm assembly 170 comprises, in the illustrated embodiment, first and second spaced-apart mounting plates 172A and 172B, first, second and third gears 174-176 and a drag generating member 178, see FIGS. 4 and 4A. The first gear 174 is rotatably mounted between the first and second mounting plates 172A and 172B. The first gear 174 comprises a shaft 174A extending through bores in the plates 172A and 172B. A pair of retainers 173 (only one of which is shown in FIG. 4) engage opposing ends of the shaft 174A to secure the plates 172A, 172B and first gear 174 in position. The first and second plates 172A and 172B are further secured to one another via pins 175A and 176A passing through the second and third gears 175 and 176 and bores in the plates 172A and 172B, see FIG. 4.

Figure 6:
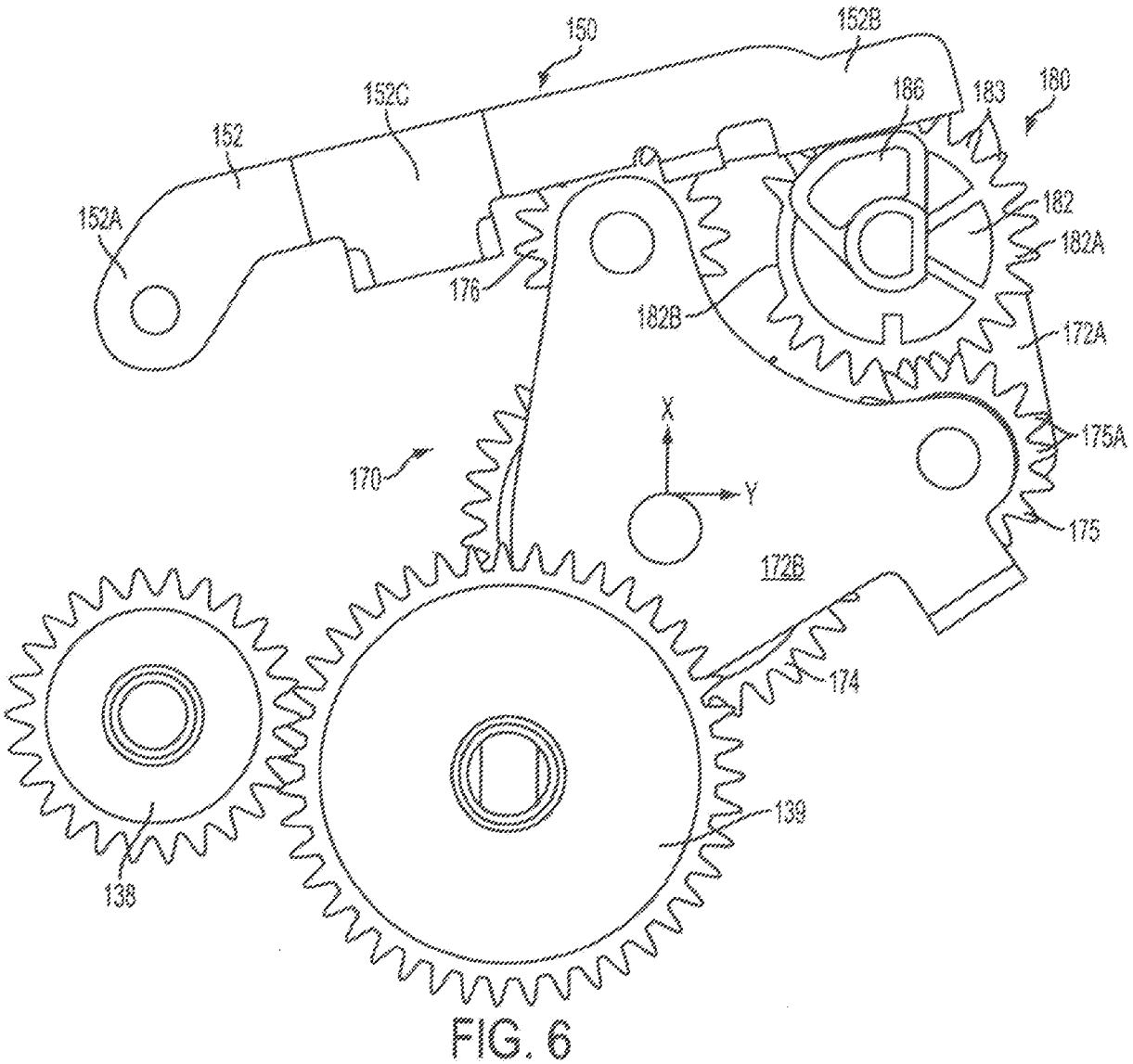
FIGS. 6-9 are views showing various states of the second compound gear, the first lever, and the swing arm assembly and with the first and second fuser structures removed.
Figure 7:
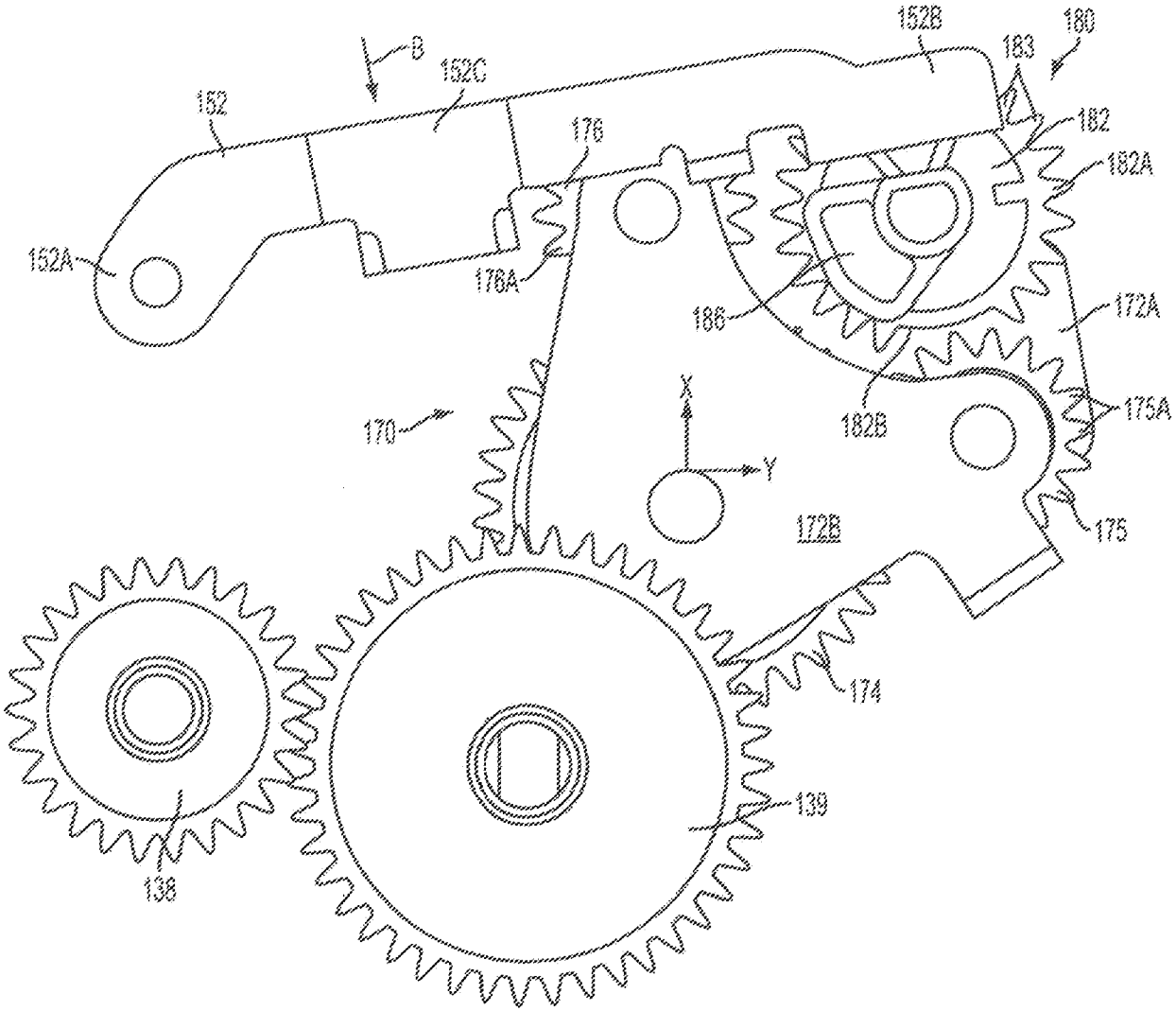
Figure 8:
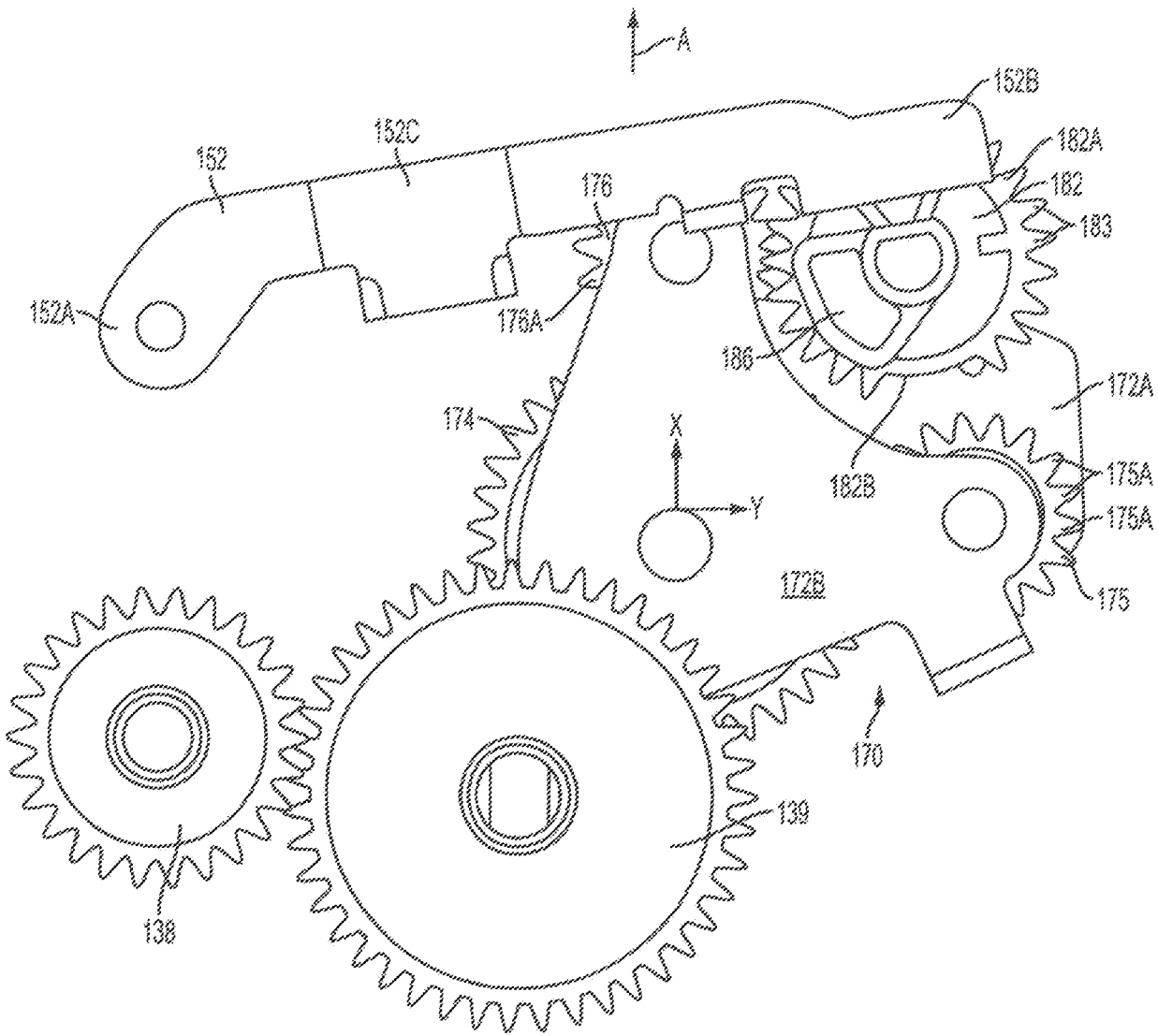
Figure 9:
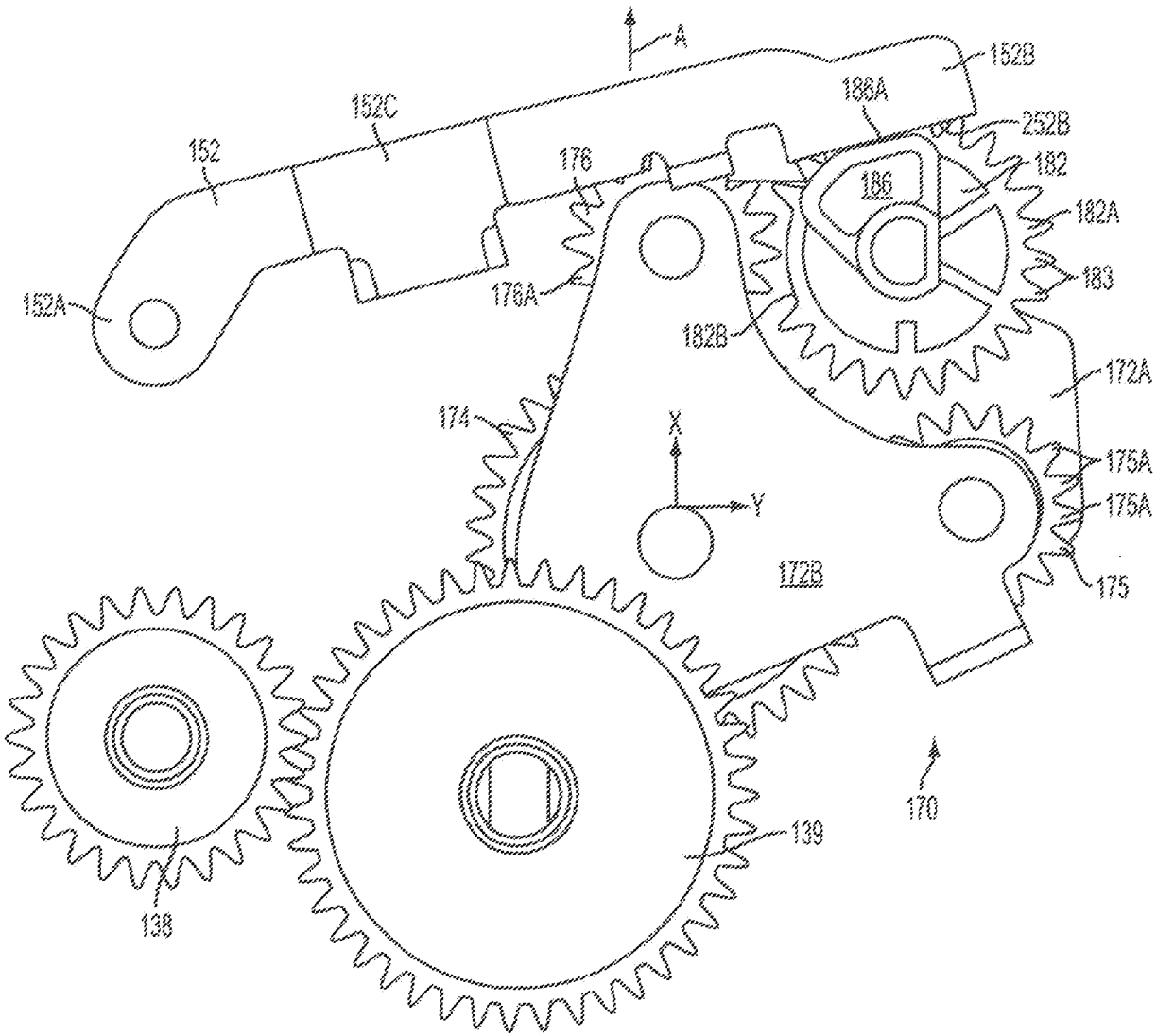

The swing arm assembly 170 pivots back and forth about an axis passing through the shaft 174A of the first gear 174 between a first end-most position, illustrated in FIGS. 6 and 7, and a second end-most position, illustrated in FIGS. 8 and 9. The first gear 174 is always in engagement with the second portion 139B of the second compound gear 139. Further, the second and third gears 175 and 176 are always in engagement with the first gear 174. Hence, the first gear 174 engages the second compound gear 139 when the swing arm assembly 170 is in its first end-most position as well as when it is in its second end-most position. Likewise, the second and third gears 175 and 176 engage the first gear 174 when the swing arm assembly 170 is in its first end-most position as well as when it is in its second end-most position. The swing arm assembly 170 moves through an angle of about 7.5 degrees when moving from its first end-most position to its second end-most position and vice versa.

In the illustrated embodiment, the drag generating member 178 comprises a helical spring 178A, shown only in FIG. 4A. The spring 178A is placed about the shaft 174A of the first gear 174 and positioned between an inner wall 1172A, see FIG. 6A, of the first plate 172A and a first side 174B, see FIG. 4, of the first gear 174. The spring 178A transfers a force via friction from the first gear 174 to the first mounting plate 172A in response to rotation of the first gear 174 by the second compound gear 139. The drag generating member 178 may comprise an element other than the helical spring 178A, such as a protrusion (not shown) extending out from the inner wall 1172A of the first plate 172A.

In first and second scenarios, the force applied by the first gear 174 to the first mounting plate 172A via the drag generating member 178 in response to rotation of the first gear 174 causes the first and second plates 172A and 172B to pivot. In the first scenario, when the swing arm assembly 170 is in its first end-most position, as shown in FIG. 7, and the second compound gear 139 rotates clockwise in FIG. 4 and counterclockwise in FIG. 7, the first gear 174 is caused to rotate counter-clockwise in FIG. 4 and clockwise in FIG. 7 causing the spring 178A to frictionally engage the inner wall 1172A of the first plate 172A and generate a force so as to move the first and second plates 172A and 172B counter-clockwise in FIG. 4 and clockwise in FIG. 7. The first and second plates 172A and 172B rotate until the third gear 176 engages a sector gear 182 such that the swing arm assembly 170 is located in its second end-most position, see FIG. 8. Once the swing arm assembly 170 is located in its second end-most position, the spring 178A allows any further clockwise rotation of the first gear 174, as viewed in FIGS. 7 and 8, to occur relative to the plates 172A and 172B. In the second scenario, when the swing arm assembly 170 is in its second end-most position, as shown in FIG. 9, and the second compound gear 139 rotates counter-clockwise in FIG. 4 and clockwise in FIG. 9, the first gear 174 is caused to rotate clockwise in FIG. 4 and counter-clockwise in FIG. 9 causing the spring 178A to frictionally engage the inner wall 1172A of the first plate 172A and generate a force so as to move the first and second plates 172A and 172B clockwise in FIG. 4 and counterclockwise in FIG. 9. The first and second plates 172A and 172B rotate until the second gear 175 engages the sector gear 182 such that the swing arm assembly 170 is in its first end-most position, see FIG. 6. Once the swing arm assembly 170 is located in its first end-most position, the spring 178A allows any further counter-clockwise rotation of the first gear 174, as viewed in FIGS. 6 and 9, to occur relative to the plates 172A and 172B.

Figure 6A:
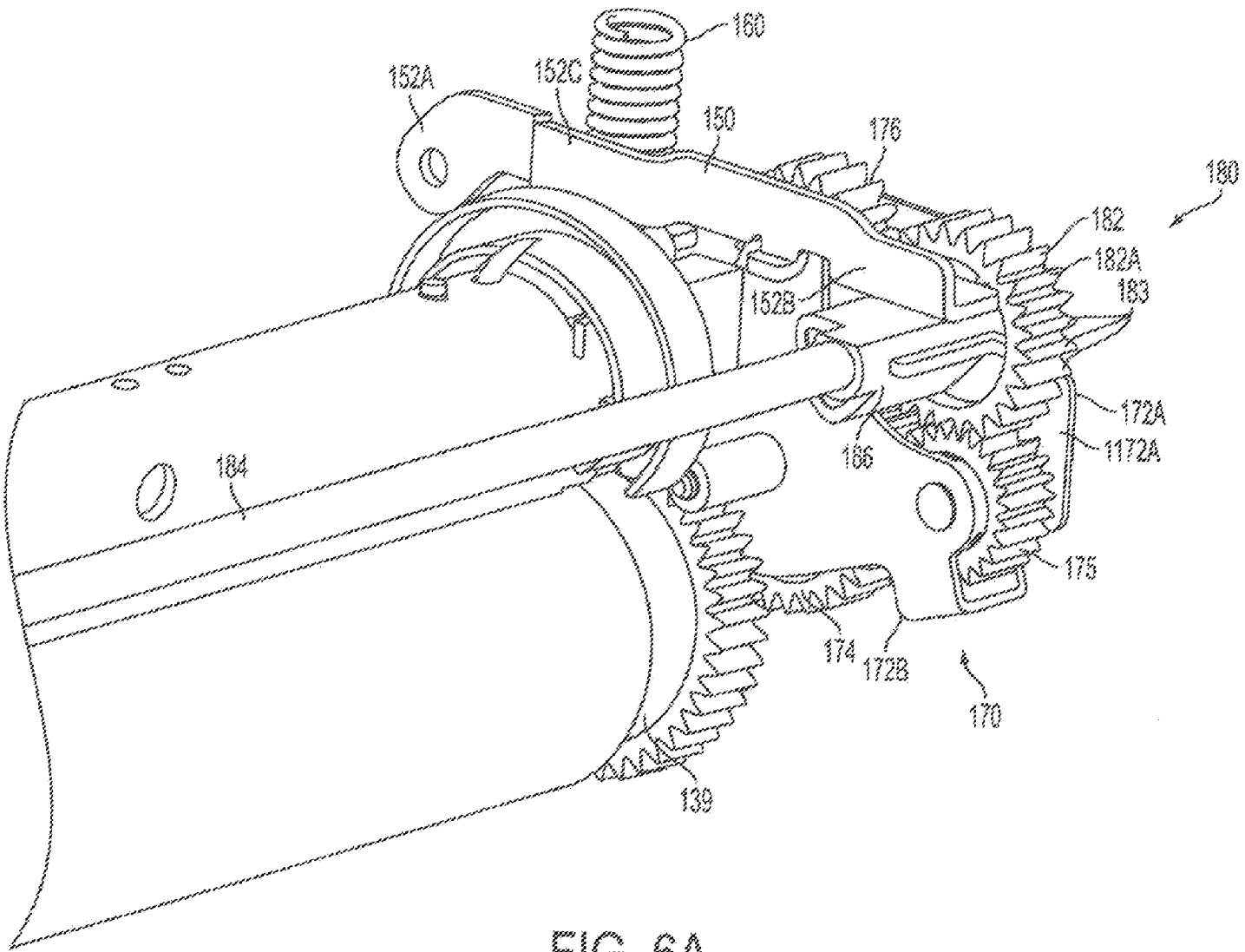
FIG. 6A is a perspective view taken from a different angle shown in FIG. 4 of the swing arm assembly of the fuser assembly illustrated in FIG. 1.

The cam assembly 180 comprises, in the illustrated embodiment, the sector gear 182, a cam shaft 184 and first and second cam elements 186 and 188, see FIGS. 3 and 6A. The first cam element 186 is integral with the sector gear 182, see FIG. 6A. The sector gear 182 comprises a first segment 182A including teeth 183 and a second segment 182B devoid of teeth, see FIG. 6. The first segment 182A defines a first arc of about 303 degrees, while the second segment 182B defines a second arc of about 57 degrees. The size of the first and second arcs may vary.

The sector gear 182, the first cam element 186 and the second cam element 188 are coupled to the cam shaft 184 for rotation with the cam shaft 184.

In the first scenario, noted above, when the swing arm assembly 170 is in its first end-most position, as shown in FIG. 7, and the second compound gear 139 rotates clockwise in FIG. 4 and counter-clockwise in FIG. 7, the first gear 174 is caused to rotate counter-clockwise in FIG. 4 and clockwise in FIG. 7 causing the spring 178A to frictionally engage the inner wall 1172A of the first plate 172A and generate a force so as to move the first and second plates 172A and 172B counter-clockwise in FIG. 4 and clockwise in FIG. 7. The first and second plates 172A and 172B rotate until teeth 176A on the third gear 176 mesh with the teeth 183 on the sector gear 182 such that the swing arm assembly 170 is in its second end-most position, see FIG. 8. Rotation of the first gear 174 counter-clockwise in FIG. 4 and clockwise in FIG. 7 causes the third gear 176 to rotate clockwise in FIG. 4 and counter-clockwise in FIG. 8. Once the teeth 176A on the third gear 176 engage with the teeth 183 on the sector gear 182, the third gear 176 causes the sector gear 182 to rotate counter-clockwise in FIG. 4 and clockwise in FIG. 8 to the position shown in FIG. 9, such that the teeth 176A on the third gear 176 are no longer in engagement with teeth 183 on the sector gear 182, but, rather, are positioned directly across from the second segment 182B of the sector gear 182, which, as noted above, is devoid of teeth. The sector gear 182 is maintained in the position shown in FIG. 9 by a flat surface 252B on the second end 152B of the first lever 152 engaging a first flat surface 186A on the first cam element 186 until the second gear 175 engages and rotates the sector gear 182, see FIG. 9.

As the sector gear 182 is rotated from its position shown in FIG. 8 to the position shown in FIG. 9, the first and second cams 186 and 188 engage the second ends 152B and 154B of the first and second levers 152 and 154 and apply an upward force generally in the direction of arrow A in FIGS. 8 and 9. Upward movement of the second ends 152B and 154B causes the levers 152 and 154 to pivot away from the backup roller 125 and compress the first and second springs 160 and 162. As the levers 152 and 154 pivot away from the backup roller 125, the forces applied by the lever extensions 152D and 154D to the endcaps 114B and 114C are reduced. Hence, the force applied by the first fuser structure 110 against the second fuser structure 120 including the backup roller 125 is reduced as well.

During prolonged inactivity of the printer 10, such as when the printer 10 is in a standby mode, or the printer 10 is being shut down, the processor actuates the motor 132 so as to rotate in a direction to effect rotation of the second compound gear 139 clockwise in FIG. 4 and counter-clockwise in FIG. 7 such that the first and second cams 186 and 188 are rotated to a position so as to cause the levers 152 and 154 to pivot away from the backup roller 125. Thus, the pressure between the first and second fuser structures 110 and 120 in the fuser nip 75 is reduced so as to reduce the likelihood that polymeric or elastomeric layers forming part of the belt 112A and the backup member 122 will be deformed permanently.

In the second scenario, noted above, when the swing arm assembly 170 is in its second end-most position, as shown in FIG. 9, and the second compound gear 139 rotates counter-clockwise in FIG. 4 and clockwise in FIG. 9, the first gear 174 is caused to rotate clockwise in FIG. 4 and counter-clockwise in FIG. 9 causing the spring 178A to frictionally engage the inner wall 1172A of the first plate 172A and generate a force so as to move the first and second plates 172A and 172B clockwise in FIG. 4 and counterclockwise in FIG. 9. The first and second plates 172A and 172B rotate until teeth 175A on the second gear 175 mesh with the teeth 183 on the sector gear 182 such that the swing arm assembly 170 is in its first end-most position, see FIG. 6. Rotation of the first gear 174 clockwise in FIG. 4 and counter-clockwise in FIG. 6 causes the second gear 175 to rotate counter-clockwise in FIG. 4 and clockwise in FIG. 6. Once the teeth 175A on the second gear 175 mesh with the teeth 183 on the sector gear 182, the second gear 175 causes the sector gear 182 to rotate clockwise in FIG. 4 and counter-clockwise in FIG. 6 to the position shown in FIG. 7, such that the teeth 175A on the second gear 175 are no longer in engagement with the teeth 183 on the sector gear 182, but rather, are positioned directly across from the second segment 182B of the sector gear 182, which, as noted above, is devoid of teeth. The sector gear 182 is maintained in the position shown in FIG. 7 by a flat surface 254B on the second end 154B of the second lever 154 engaging a flat surface 188A on the second cam element 188 until the third gear 176 engages a rotates the sector gear 182, see FIG. 3.

As the sector gear 182 is rotated from its position shown in FIG. 6 to the position shown in FIG. 7, the first and second cams 186 and 188 are rotated so as to disengage the second ends 152B and 154B of the first and second levers 152 and 154. In response, the springs 160 and 162 expand and apply downward forces onto the extensions 152D and 154D of the first and second levers 152 and 154 generally in the direction of arrow B in FIG. 7. The downward forces generated by the expanded springs 160 and 162 against the extensions 152D and 154D cause the second ends 152B and 154B of the levers 152 and 154 to pivot clockwise in FIGS. 6 and 7 and move toward the backup roller 125. The downward forces from the springs 160 and 162 onto the extensions 152D and 154D further cause the extensions 152D and 154D to apply increased forces onto the endcaps 114B and 114C so as to increase the force applied by the first fuser structure 110 against the second fuser structure 120. The spring rates of the springs 160 and 162 are preferably selected such that the forces applied by the extensions 152D and 154D onto the endcaps 114B and 114C are sufficient to achieve a desired nip load, i.e., a desired compressive load within the nip 75.

When the printer 10 is initially turned on or reactivated after a prolonged period of inactivity, the processor actuates the motor 132 so as to rotate the motor 132 in a direction to effect rotation of the second compound gear 139 counter-clockwise in FIG. 4 and clockwise in FIG. 9 such that the first and second cams 186 and 188 are rotated to a position so as to cause the levers 152 and 154 to pivot toward the backup roller 125. Hence, the pressure between the first and second fuser structures 110 and 120 in the fuser nip 75 is increased to a desired nip pressure.

In the fuser assembly 100, no sensors are provided to determine the positions of any element of the first and second fuser structures 110 and 120, the gear train 134 or the nip engagement and release mechanism 140. Hence, the fuser assembly 100 does not comprise a sensor feedback loop.

It is contemplated that the heated rotatable member of the first fuser structure may comprise a heater roller and/or the backup member of the second fuser structure may comprise a backup belt.

It is contemplated that a one-way clutch may be positioned between a shaft of the backup roller 125 and the second compound gear 139 so as to prevent reverse movement of the backup roller 125 and the belt 112A when the second compound gear 139 rotates clockwise in FIG. 4 and counter-clockwise in FIG. 7 so as to reduce the pressure between the first and second fuser structures 110 and 120 in the fuser nip 75.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuser assembly comprising:

first fuser structure comprising a heated rotatable member and first structure for supporting said heated rotatable member;

second fuser structure comprising a rotatable backup member positioned adjacent said heated rotatable member and second structure for supporting said backup member, said rotatable backup member adapted to define a nip with said heated member;

drive apparatus associated with one of said heated rotatable member and said backup member for effecting rotation of said one member in a selected first direction or a second direction; and nip engagement and release apparatus comprising nip-loading structure adapted to apply a sufficient force to one of said first and second support structures to achieve a desired nip load in response to said one member rotating in said first direction and decreasing said force to said one support structure to decrease the load at said nip in response to said one member rotating in said second direction, said nip engagement and release apparatus applying and decreasing said force without the use of a sensor feedback loop for determining positions of said first fuser structure, said second fuser structure and said drive apparatus, wherein said nip engagement and release apparatus further comprises:

at least one spring for engaging said nip-loading structure;

a swing arm assembly operable to pivot to a first position in response to said one member rotating in said first direction and to a second position in response to said one member rotating in said second direction; and a cam assembly coupled to said swing arm assembly and said drive apparatus, including at least one cam element for positioning said nip-loading structure to apply said sufficient force to said one support structure in response to said one member rotating in said first direction, and for positioning said nip-loading structure to decrease the force applied to said one support structure in response to said one member rotating in said second direction, said cam assembly being engaged with said swing arm assembly when said swing arm assembly is in said first position and said second position.

2. A fuser assembly as set out in claim 1, wherein said first fuser structure further comprises a heater element, and said first support structure comprises a bracket supporting said heater element and first and second endcaps for supporting said bracket, and said heated rotatable member comprises an endless belt positioned about said heater element and said bracket and is supported by said bracket and said endcaps.

3. A fuser assembly as set out in claim 1, wherein said backup member comprises a backup roll and said second support structure comprises a pair of bearings mounted within a frame for supporting said backup roll.

4. A fuser assembly as set out in claim 3, wherein said drive apparatus comprises a motor and a gear train, said gear train including a gear coupled to said backup roll.

5. A fuser assembly comprising:

first fuser structure comprising a heated rotatable member and first structure for supporting said heated rotatable member;

second fuser structure comprising a rotatable backup member positioned adjacent said heated rotatable member and second structure for supporting said backup member, said rotatable backup member operable to define a nip with said heated member;

drive apparatus associated with one of said heated rotatable member and said backup member for effecting rotation of said one member in a selected first direction or a second direction; and nip engagement and release apparatus comprising nip-loading structure to apply a sufficient force to one of said first and second support structures to achieve a desired nip load in response to said one member rotating in said first direction and decreasing said force to said one support structure to decrease the load at said nip in response to said one member rotating in said second direction, said nip engagement and release apparatus applying and decreasing said force without the use of a sensor feedback loop for determining positions of said first fuser structure, said second fuser structure and said drive apparatus, wherein said nip engagement and release apparatus further comprises:

at least one spring for engaging said nip-loading structure;

a swing arm assembly for pivoting to a first position in response to said one member rotating in said first direction and to a second position in response to said one member rotating in said second direction; and a cam assembly including at least one cam element for positioning said nip-loading structure to apply said sufficient force to said one support structure in response to said one member rotating in said first direction and for positioning said nip-loading structure to decrease the force applied to said one support structure in response to said one member rotating in said second direction, wherein said swing arm assembly comprises:

first and second spaced-apart mounting plates coupled to one another;

a first gear mounted between said first and second mounting plates adapted to engage with a gear forming part of said drive apparatus, said swing arm assembly pivoting about an axis of said first gear;

a drag generating member provided between said first plate and said first gear, said drag generating member transferring a force via friction from said first gear to said first mounting plate in response to rotation of said first gear, said force causing said first and second plates to pivot in response to movement of said first gear; and second and third gears mounted between said mounting plates and in engagement with said first gear for rotation with said first gear.

6. A fuser assembly as set out in claim 5, wherein said cam assembly comprises:

a sector gear comprising a first segment including teeth and a second segment devoid of teeth;

a cam shaft coupled to said sector gear for rotation with said sector gear; and a first cam element coupled to said cam shaft for rotation with said cam shaft, wherein said second gear causing said sector gear to rotate to effect movement of said cam shaft to cause said first cam element to position said nip-loading structure to apply said sufficient force to said one support structure and said third gear causing said sector gear to rotate to cause said first cam element to position said nip-loading structure to decrease the force applied to said one support structure.

7. A fuser assembly as set out in claim 6, wherein said cam assembly further comprises a second cam element.

8. A fuser assembly as set out in claim 7, wherein said nip-loading structure comprises:

a first lever pivotably coupled at a first end to a frame and comprising an intermediate portion for engaging said one support structure and a second end for engaging said first cam element; and a second lever pivotably coupled at a first end to the frame and comprising an intermediate portion for engaging said one support structure and a second end for engaging said second cam clement.

9. A fuser assembly as set out in claim 8, wherein said at least one spring comprises first and second springs, said first spring extending between the frame and said first lever and said second spring extending between the frame and said second lever.

10. A fuser assembly as set out in claim 5, wherein said drag generating member comprises a spring.

11. A pressure application assembly comprising:

first structure comprising a first rotatable member and first support structure for supporting said first rotatable member;

second structure comprising a second rotatable member positioned adjacent said first rotatable member and second support structure for supporting said second member, said second member adapted to define a nip with said first member;

drive apparatus associated with one of said first rotatable member and said second rotatable member for effecting rotation of said one member in a selected first direction or a second direction: and nip engagement and release apparatus comprising nip-loading structure adapted to apply a sufficient force to one of said first and second support structures to achieve a desired nip load in response to said one member rotating in said first direction and decreasing said force to said one support structure to decrease the load at said nip in response to said one member rotating in said second direction, said nip engagement and release apparatus applying and decreasing said force without the use of a sensor feedback loop for determining positions of said first fuser structure, said second fuser structure and said drive apparatus, wherein said nip engagement and release apparatus further comprises:

at least one spring for engaging said nip-loading structure;

a swing aim assembly adapted to pivot to a first position in response to said one member rotating in said first direction and to a second position in response to said one member rotating in said second direction; and a cam assembly coupled to said swing arm assembly and said drive apparatus, including at least one cam element for positioning said nip-loading structure to apply said sufficient force to said one support structure in response to said one member rotating in said first direction, and for positioning said nip-loading structure to decrease the force applied to said one support structure in response to said one member rotating in said second direction, said cam assembly being engaged with said swing arm assembly when said swing arm assembly is in said first position and said second position.

12. A pressure application assembly as set out in claim 11, wherein said second member comprises a backup roll and said second support structure comprises a pair of bearings mounted within a frame for supporting said backup roll.

13. A pressure application assembly as set out in claim 12, wherein said drive apparatus comprises a motor and a gear train, said gear train including a gear coupled to said backup roll.

14. A pressure application assembly as set out in claim 11, wherein said swing arm assembly comprises:

first and second spaced-apart mounting plates coupled to one another;

a first gear mounted between said first and second mounting plates adapted to engage with a gear forming part of said drive apparatus, said swing arm assembly pivoting about an axis of said first gear;

a drag generating member provided between said first plate and said first gear, said drag generating member transferring a force via friction from said first gear to said first mounting plate in response to rotation of said first gear, said force causing said first and second plates to pivot in response to movement of said first gear; and second and third gears mounted between said mounting plates and in engagement with said first gear for rotation with said first gear.

15. A pressure application assembly as set out in claim 14, wherein said cam assembly comprises:

a sector gear comprising a first segment including teeth and a second segment devoid of teeth;

a cam shaft coupled to said sector gear for rotation with said sector gear; and a first cam element coupled to said cam shaft for rotation with said cam shaft, wherein said second gear causing said sector gear to rotate to effect movement of said cam shaft to cause said first cam element to position said nip-loading structure to apply said sufficient force to said one support structure and said third gear causing said sector gear to rotate to cause said first cam element to position said nip-loading structure to decrease the force applied to said one support structure.

16. A pressure application assembly as set out in claim 15, wherein said cam assembly further comprises a second cam element.

17. A pressure application assembly as set out in claim 16, wherein said nip-loading structure comprises:

a first lever pivotably coupled at a first end to a frame and comprising an intermediate portion for engaging said one support structure and a second end for engaging said first cam element; and a second lever pivotably coupled at a first end to the frame and comprising an intermediate portion for engaging said one support structure and a second end for engaging said second cam element.

18. A pressure application assembly as set out in claim 17, wherein said at least one spring comprises first and second springs, said first spring extending between the frame and said first lever and said second spring extending between the frame and said second lever.

* * * * *